United States Patent [19]

Düpree

[11] 4,011,706

[45] Mar. 15, 1977

[54] CORNER CONNECTOR FOR BOARD SHAPED COMPONENT PARTS

[76] Inventor: Hans-Werner Düpree, 154 Osnabrucker Landstrasse 11 Gutersloh, Germany

[22] Filed: May 30, 1975

[21] Appl. No.: 582,294

[30] Foreign Application Priority Data

June 1, 1974 Germany ..... 2426723

[52] U.S. Cl. ..... 403/231; 403/231; 217/65; 220/338; 403/406; 52/285

[51] Int. Cl.[2] ..... F16B 2/20

[58] Field of Search ..... 52/753 C, 753 D; 160/381; 312/330, 214, 140; 217/65; 220/337, 338, 339; 211/42; 403/231

[56] References Cited

UNITED STATES PATENTS

| | | | |
|---|---|---|---|
| 2,002,228 | 5/1935 | Meyercord et al. | 52/753 D X |
| 2,274,765 | 3/1942 | Zalkind | 52/753 D UX |
| 3,385,450 | 5/1968 | Nadler et al. | 211/42 |
| 3,424,365 | 1/1969 | Venturi | 312/330 UX |
| 3,759,600 | 9/1973 | MacDonald | 312/330 |
| 3,768,846 | 10/1973 | Hensley | 52/753 D X |
| 3,901,572 | 8/1975 | Litchfield | 312/330 |

FOREIGN PATENTS OR APPLICATIONS

| | | | |
|---|---|---|---|
| 1,208,853 | 1/1966 | Germany | 312/140 |

*Primary Examiner*—Wayne L. Shedd
*Attorney, Agent, or Firm*—Charles E. Baxley

[57] ABSTRACT

A corner connector for board shaped component parts for manufacture of boxes, drawers and the like is characterized in that a middle part, from which tenons project to both sides, is formed as a plastic sheeting hinge. There are formed on both sides of the hinge line inwardly projecting formations which interengage at the back in the angular position. The middle part forms in an inswung closed condition a post of rectangular cross section.

9 Claims, 16 Drawing Figures

Fig. 2
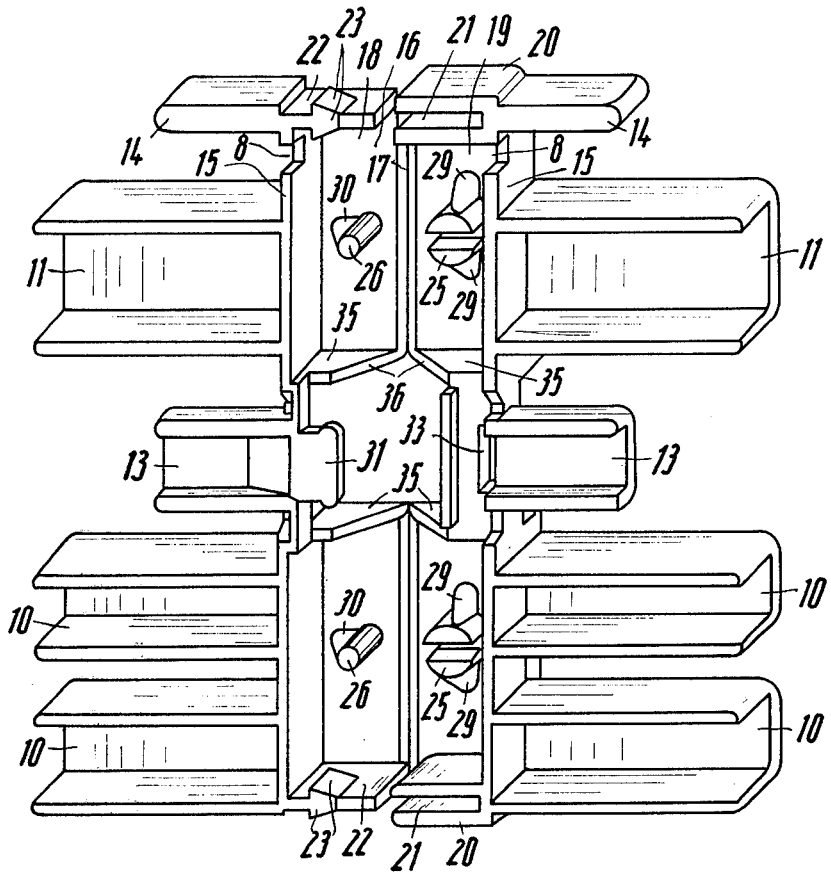
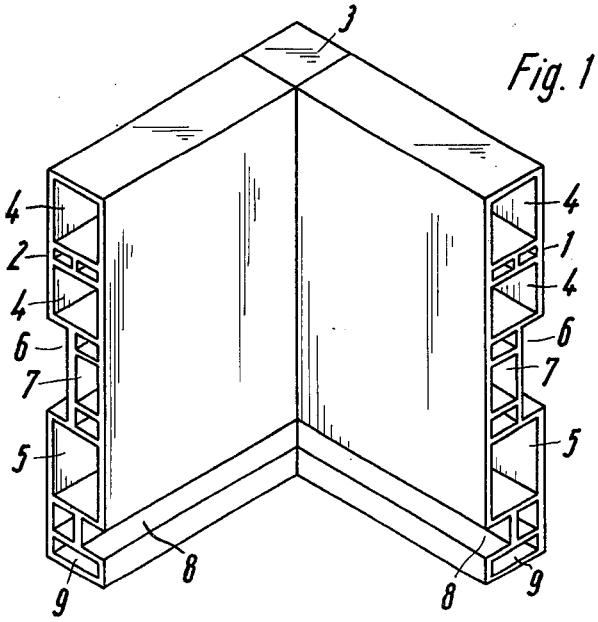
Fig. 1

Fig. 3
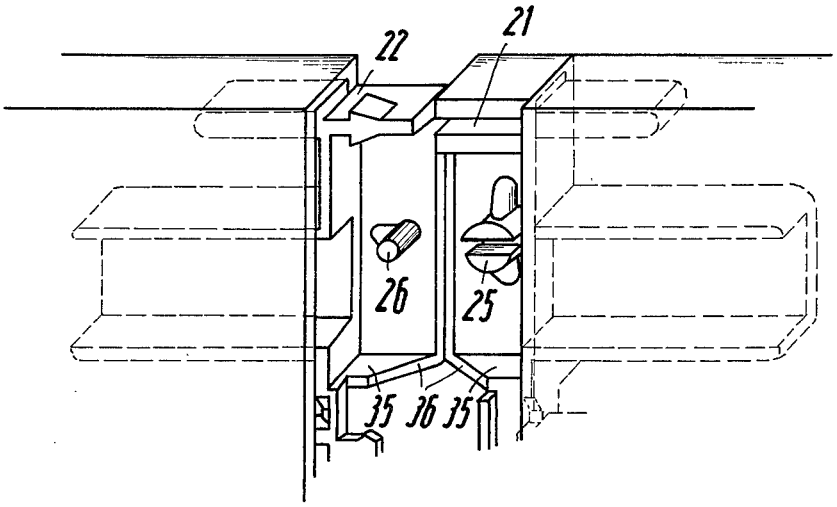
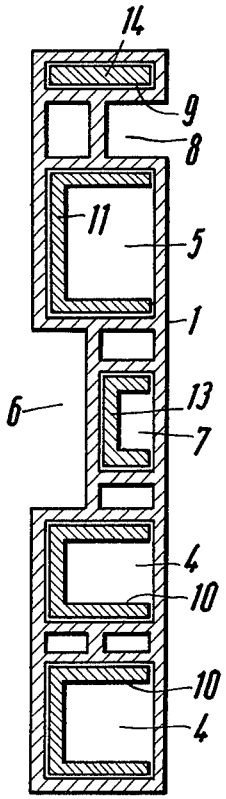
Fig. 5

CORNER CONNECTOR FOR BOARD SHAPED COMPONENT PARTS

BACKGROUND OF INVENTION

The invention relates to a corner connector for board shaped component parts, such as wooden panels, covered chipboards, and especially mortice section shapes extruded from plastics material for manufacture of boxes, drawers and the like.

Corner connectors for board shaped component parts with mortices for corner connection are known principally in two different specific constructions. One construction consists of a post shaped middle part which forms the corner. The middle part is of a height corresponding to the thickness of the board shaped component parts. Tenons are formed at an angle to one another at both sides on the middle part, these tenons being inserted in the mortices of the board shaped component parts. The corner connector consists of plastics material and the board shaped component parts likewise consist of plastics material, and are preferably manufactured by extrusion.

Another type of corner connectors, which can also be used for board shaped component parts with mortices, but are intended to be used for board shaped component parts which are solid and are provided with a surface cladding, consist of lamellar parts which interlock on the inner side of mitre cut ends of the board shaped parts. In this type of construction, only a mitre joint can be seen in the finished corner connection. A development of this type of construction makes use of a thin layer of plastics material applied on the board shaped component parts, e.g., chipboard covered by plastics sheeting, which is continuous, two adjacent component parts forming a hinge at the point of a mitre cut and holding the parts together. In a similar manner, mortice sections of plastics material are provided with a mitre cut, which does not continue to the outer side, and swivel relative to one another. Such a corner connection is however comparatively difficult to manufacture as it must be provided in any case with glue before the jointing and in many forms of construction yet additional connecting members must be glued. Thus, in the manufacture a suitable amount of time must be allowed for applying the glue, jointing, and above all for setting of the glue, quite apart from the expenditure in equipment necessary therefor.

In the case of the corner connectors with tenons, described in the first instance, special equipment and above all a glue supply are not necessry in all forms of construction, as the tenons may be provided also with teeth, which are firmly tied in the mortices of the slipped on board shaped component parts. Another specific construction consists in inserting special locking pins in transversely extending bores after putting the board shaped component parts on to the tenons. A special working effort and thus a wastage of time is likewise necessary with special equipment for provision of the bores and the locking pins. Such corner connections are used extensively in the manufacture of drawers for the furniture industry, but also elsewhere for the manufacture of box shaped articles such, for example, as wall cupboards or even shipping boxes and the like. If these drawers or other articles are finished by the manufacturer, in order to be sent to the user, considerable transport problems arise for it is not possible to pact the finished articles economically, nesting one within another is not practicable, and therefore the use made of the packing or storage space quite inadequate. If the articles are put together by the purchaser from parts prepared by the manufacturer, there is a considerable additional wastage of time for the purchaser, and possibly expenditure in equipment.

STATEMENT OF INVENTION

This invention has taken on the problem of avoiding the hereinbefore described disadvantages of corner connections of board shaped component parts for making up boxes, drawers and the like, and in accordance with the invention there is to be provided a simple and secure corner connection which can be accomplished without special equipment and by unskilled workmen, and very economical transport is made possible with significant packing densities and only an extremely small expenditure in additional work is required of the user.

According to the invention, a corner connector for board shaped component parts for the manufacture of boxes, drawers and the like is characterized in that a middle part, from which tenons project to both sides, is formed as a plastics sheeting hinge, and there are formed on both sides of the hinge line inwardly projecting formations which interengage at the back in an angular position. The middle part forms in an inswung closed condition a post of rectangular cross setion. It has upper and lower closure plates in the shape of the cross section of the post, which overlap in the inswung condition and are provided on the face to face surfaces preferably with interengaging profiling such, for example, as opposite sets of teeth. The aligned closure plates on the middle part are formed on both sides of the hinge line with interengaging features, two on the one side and one on the other, and in the clearance between the two.

The formations on the inner surfaces of the middle part are provided on the one hand with slots in an undercut enlargement at the bottom and on the other hand as pins engaging in this enlargement. These formations may also be arranged alternately on both sides. On the side walls of the middle part parallel to the hinge line there are formed on the inner edge of the one side a barbed pin and on the other side a formation with a slot through which this pin can be inserted. The middle part may have several intermediate walls parallel to the closure plates, said walls being provided with mitre cuts and forming partitions in the folded together condition. In one embodiment, the outer surfaces of the middle part forming a post overlap the tenons in order to increase the wall thickness of the component parts slipped on to the tenons. According to another embodiment, the external surfaces of the middle part forming a post are coplanar with the adjacent tenon surfaces, and the board shaped parts slipped onto the tenons conceal the corner connector with their outer surfaces and are provided on the narrow sides with a mitre cut.

The invention offers the essential advantage that the board shaped component parts can be slipped onto the corner connectors and are arranged flat against one another for a box or a drawer, that is all four side walls, or even, as is often the case with drawer constructions, three side walls, that is the two side walls and the rear wall, while the front wall, constructed of specially treated wood is separately put on only later. In this flat relationship, but fixedly connected with one another, the board shaped component parts can be stacked closely for shipment and/or for storage. For use, each individual series of components or component parts is taken up, is bent at the desired angle at the sheet hinges of the corner connector, for example, through 90°, and at the same time the formations arranged in the corner connectors interengage and thus hold two adjacent board shaped component parts at an angle to one another. Through the cooperation of the sheet hinges with the formations engaging with one another, a fixed and secure corner connector is produced and cannot ever be broken down when the interengaging formations are appropriately formed. The board shaped component parts are pushed in known manner on to the tenons, and if desired, are connected in known manner undetachably with the latter, for example by mutually interengaging sets of teeth. Of course the board shaped component parts may in known manner also be glued or welded on to the tenons. As these board shaped component parts are initially coplanar with the tenon connectors, such gluing or welding can be carried out easily and continuously on special automatically operating equipment so that no labor is necessary therefor and only an extremely small wastage of time is involved. The board shaped component parts adhering together in a series in the corner connector are simple and are easily manipulated and packed or unpacked even mechanically; they are packed extremely closely so that transport or storage space can be used to the full.

DESCRIPTION OF DRAWINGS

The invention will hereinafter be described in more detail by way of specific embodiments with reference to the accompanying drawings in which:

FIG. 1 is a diagrammatic perspective view of a corner connection, for explanatory purposes;

FIG. 2 is a perspective view of a corner connector according to the invention;

FIG. 3 shows part of a corner connector in accordance with FIG. 2 with slipped on indicated board shaped component parts according to one embodiment;

FIG. 5 is a cross section of a board shaped component part with mortices and intended for use in the construction of a drawer;

DESCRIPTION OF PREFERRED EMBODIMENT

Figure 4:
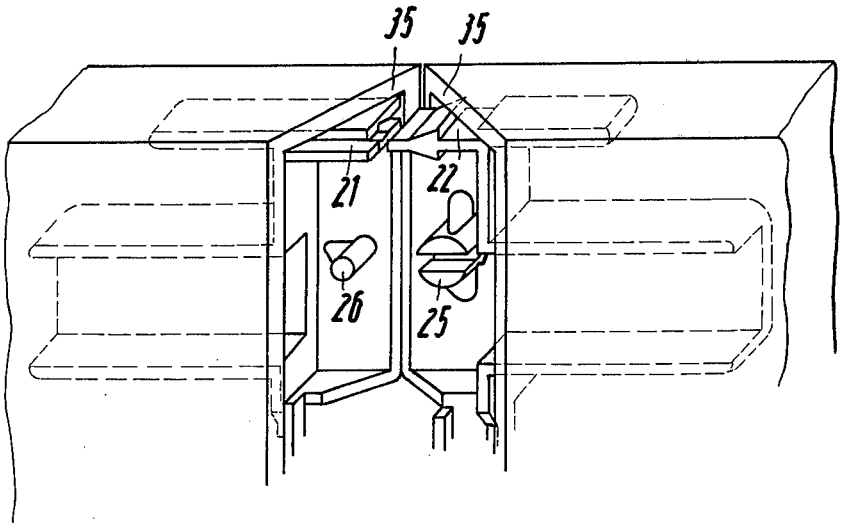
FIG. 4 is a view similar to FIG. 3, according to another embodiment.

The description is given in relation to a drawer, as the shape of the latter shows certain characteristics. A box shape is substantially simpler and may be derived therefrom by omitting the characteristics present in a drawer. The joining of a corner connector according to the invention on to the board shaped component parts may be dealt with as is known in various ways. Tenons may be arranged, made to fit the cross sections of the mortices of hollow section shaped extruded from plastics material, thus with rectangular cross section. These items may be glued or welded into the mortices of the board shaped component parts; they may also be provided with teeth of which counterteeth may also be arranged in the mortices.

Another fastening possibility consists in providing a bore penetrating the moritces and the tenons and inserting a drop pin into said bore after the assembly.

When the board shaped component parts consist of solid material, dowel pins may be provided at the corner connectors for insertion into dowel holes in the front sides of the component parts. There may also be arranged at the corner connectors sleeves into which the component parts are inserted with appropriate fixing as with the tenons. The board shaped component parts may moreover, be provided with reductions in cross section in the region the sleeves are slipped thereover, so that there is another external surface. FIG. 1 serves for illustration. In this Figure there are two board shaped component parts 1 and 2 slipped on to the tenons of a corner connector 3. The board shaped component parts have a number of mortices, namely two upper mortices 4 of substantially the same size and square in cross section, and a lower mortice 5 with just that cross section. Above the mortice 5 at the outer side of the board shaped component parts 1 and 2 is formed a broad guide groove 6 along which the drawer is placed in its ribbed guide. A shallow mortice 7 is formed behind this guide groove 6. Below the lower mortice 5 there is formed a narrow guide groove 8 which is open towards that side of the board shaped component part which is opposite to the guide groove 6. This groove 8 serves for insertion of a bottom board into the drawer. A narrower mortice 9 is formed below this groove 5 in the component part. The corner connector is formed as a post like corner connector from which project, molded at right angles to one another, tenons which engage in all or some of the mortices in the board like component parts.

The corner connector shown in FIG. 2 is turned upside down in a perspective representation for facility of inspection. The representation corresponds to the upper end of the corner connector 3 of FIG. 1. For these reasons firstly the tenons provided on the corner connector in FIG. 2 are illustrated from bottom to top, corresponding to the moritces illustrated in FIG. 1 from top to bottom. According to FIG. 2, two tenons 10 approximating to square cross section are made on the corner connector to engage in the mortices 4 of the board shaped component part. After that, spaced thereabove, there is arranged a large tenon 11, likewise approximating to square cross section, to engage in the mortice 5. Between the two lower tenons 10 and the upper tenon 11 there is a shallow tenon 13 to engage in the shallow mortice 7, and above the single tenon 11 is a flat, solid, transversely extending tenon 14 to engage in the narrow mortice 9. The tenons are generally formed with a U-shaped cross section, on the one hand because of molding techniques, and on the other hand because a substantially more secure mounting in the mortices can be achieved with this construction.

The tenons 10 to 14 are molded at a middle part, the actual corner connector. This middle part is of substantially U-shaped cross section, the tenons being molded on the actual side walls 15 and the base 16 being formed along its midline as a plastics sheeting hinge 17. Between the tenons 11 and 14 there is hollowed out in the side wall 15 a groove 8 which registers with the groove 8 in the board shaped component parts for insertion of a bottom board.

The corner connector consists of a plastics material which has a certain elasticity or flexibility. The middle part is formed in its base 16 firstly as a flat wall and is provided at the bend line 17 with a slit with inclined side walls, so that the parts of the wall 16 at each side of the slit in the bend line 17 can be swung horizontally towards one another in the manner of a hinge, so that the two wall parts 18 and 19 are at right angles to one another and the face outer edges of the side wall 15 butt against one another. In this way, after the swinging and bending of the middle part there is therefrom a post like middle part from which tenons project at right angles to one another. Of course, any other desired angular settings may be produced with suitable construction.

In order to keep the middle part in the bent post forming setting, there are formed at both sides of the bend line 17 at both halves 18 and 19 of the hinge of the base wall 16, shaped parts which in the 90° position engage one another into or behind one another. In the embodiment shown three different kinds of such shaped parts are reproduced.

Firstly, there are formed at both ends of the middle part, closure plates 20 which are at right angles both to the hinge half 19 and to the side walls 15. The closure plates are of the shape of the cross section of the column when in the inswung setting. The closure plate 20 is moreover formed as a pair of plates, i.e., it has a slot 21, and positioned closure plate 22 is formed on the hinge part 18 in such a way that is is opposite this slot 21. It can be seen that, when the two hinge parts are folded or swung together, the closure plate 22 is pushed into the slot 21 of the oppositely disposed closure plate 20 and is engaged there.

Figure 10:
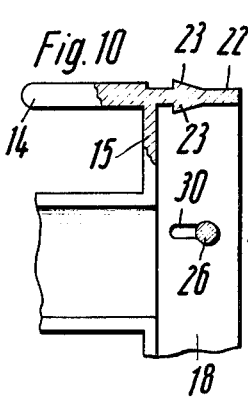
FIG. 10 is a section along the line X—X of FIG. 7.
Figure 9:
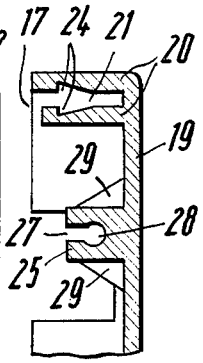
FIG. 9 is a section along the line IX—IX of FIG. 6.

In order to achieve a firm joint, the closure plate 22 is provided at both of its outer surfaces with barb shaped formations 23, and corresponding recesses 24 are provided in the mutually facing surfaces of the plates of the pair of plates 20 (see FIGS. 9 and 10). There can be seen in FIG. 11 how these interengaging formations 23 and recesses 24 wedge with one another in the drawn together condition and so ensure the unity of the parts.

Figure 11:
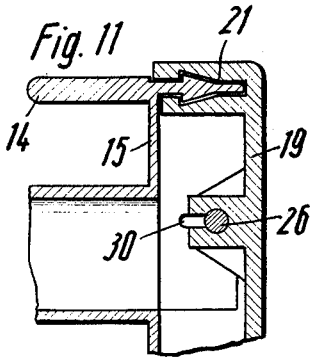
FIG. 11 shows the two sections of FIGS. 9 and 10 in the folded together condition.

Further formations engaging together after the folding are a cylindrical member 25 on the hinge part 19 and a pin or cylindrical part 26 on the hinge part 18. In accordance with FIG. 9 the cylindrical formation 25 has a slot 27 with an enlargement or widened portion 28 cut into the back portion thereof. The pin 26 or cylindrical part on the opposite hinge part 18 passes into this widened portion 28 after it is introduced through the slot 27 with slight deformation on swinging the hinge parts towards one another. In much the same way as with a press stud, the part 26 is held in the widened portion 28 in the folded condition of the hinge as is shown in FIG. 11. Braces 29 on the cylindrical part 25 and 30 on the pin 26 serve to hold and stabilize these parts, the brace 30 being located in the slot 27 after the folding. By providing several parts of these formations, the parts 25 and 26 are advantageously arranged alternatingly on the hinge parts 18 and 19 so that there is a cross connecting clamping.

Figure 12:
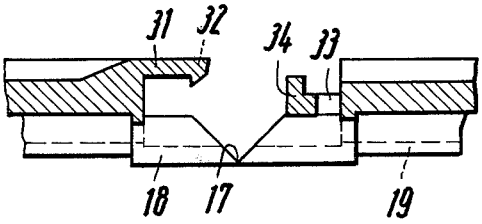
FIG. 12 is a section along the line XII—XII of FIG. 6.
Figure 13:
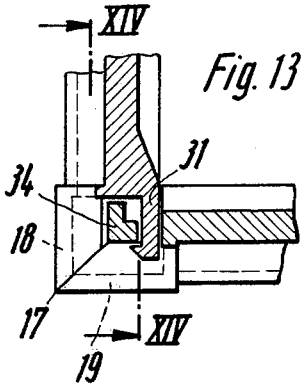
FIG. 13 shows the FIG. 12 construction in the folded together condition.
Figure 14:
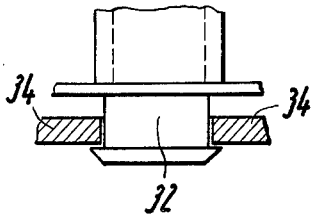
FIG. 14 is a section along the line XIV—XIV of FIG. 13.
Figure 6:
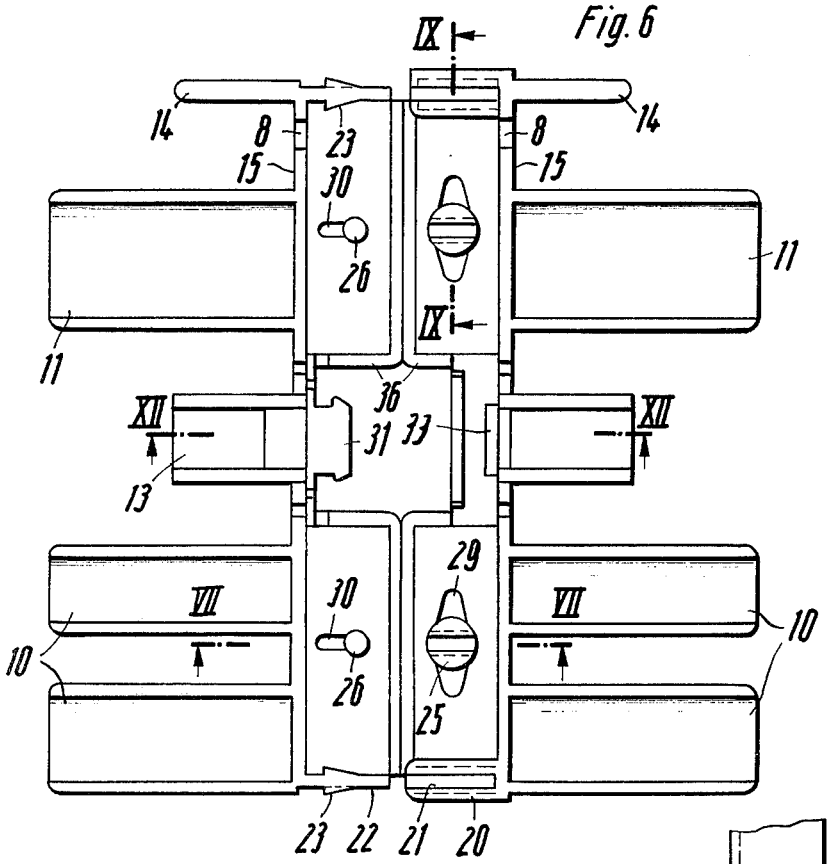
FIG. 6 is a side view of a corner connector.
Figure 7:
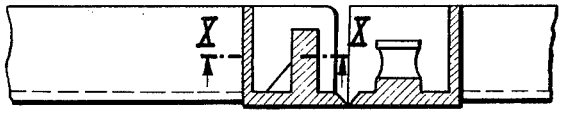
FIG. 7 is a section along the line VII—VII of FIG. 6.
Figure 8:
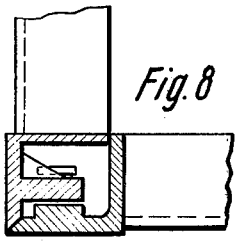
FIG. 8 shows the FIG. 7 construction in the folded condition.

A further construction of formations, which interengage after the folding, are an arm 31 and a slot 33. As can be seen in FIG. 12, the arm 31 in the region of the free outer edge of the wall 15 is shaped and is provided at its outer end with a thickened portion 32 which may be developed on more than one side. This thickened portion 32 is preferably in the form of a barb. A slot 33 is formed in a projecting flange 34 on the oppositely disposed side wall 15 of the U-shape. As can be seen in FIG. 13, these two formations interengage after the folding and are caught together, so that the hinge is held in the folded condition and, in the event that the formations are appropriately formed, remain locked in this position. For that purpose FIG. 14 shows a longitudinal section through this interconnection of the two parts 31 and 32 or 34.

A corner connector of the form hereinbefore described may be so designed that after folding or swinging of the two hinge halves through 90° and locking thereof together, there is formed a post shaped middle part such as was descirbed in connection with FIG. 1. This post shaped middle part can then be recognized in assembled drawers or assembled boxes. The outer surfaces of the hinge parts 18 and 19 and also the outer surfaces of the closure plates 20 are then offset outwardly relative to the adjacent surfaces of the tenons, namely by the thickness of the wall parts of the mortices, as can be seen for example in FIG. 5. This embodiment is shown in FIG. 3. The outer surfaces of the board shaped component parts and the outer surfaces of the post shaped middle part of the corner connector then lie in one plane.

Another embodiment according to FIG. 4 is formed in such a way that the outer surfaces of the hinge parts 18 and 19 together with the outer surfaces of the closure plate 20 are coplanar with the adjacent tenon parts. The component parts pushed over the tenons then overlap these outer surfaces. The component parts are provided in both narrow outer surfaces with mitre cuts 35. After folding of the corner connector, only one mitre joint can be seen between the board shaped component parts, the corner connector disappearing completely within the mortices of the board shaped component parts. The latter are, moreover, of course formed in such a way that the walls of the mortices are cut away between the two outer narrow surfaces in order to make sufficient room for the corner connector.

Figure 15:
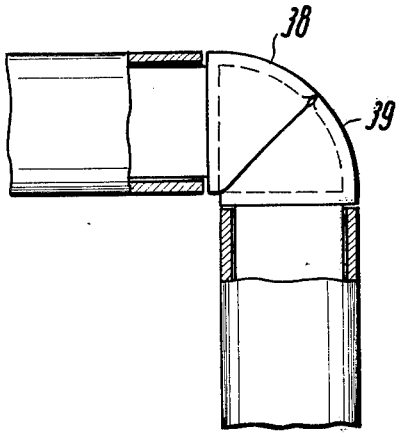
FIG. 15 is a view of a further embodiment of the corner connector with bent cross section in the inswung condition.
Figure 16:
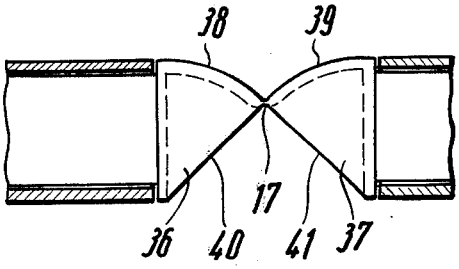
FIG. 16 is a view of a corner connector according to FIG. 15 in the upswung open condition.

A further embodiment is shown in FIGS. 15 and 16. In this instance, the middle part is formed in such a way that it provides a post with the cross section of a quadrantal sector, in the inswung closed condition. The curved side is outwards and forms a rounded corner. The middle part has at least upper and lower closure plates which are divided into two halves 36 and 37. These halves have the form of an octantal sector with the arcs 38, 39 at the outside and they meet and hang together at the hinge line 17. From the hinge line 17 outwardly the limits of the two halves continue inwardly in straight lines. The two limiting lines form a mitre cut. The middle part is externally limited by part-cylindrical outer surfaces which are in surface continuation with the arcuate parts of the arcs 38, 39 of the closure plate.

On swinging inwards into the angular position, corresponding to FIG. 15, the two limiting surfaces 40, 41 of the mitre cut abut, and the external surfaces 38, 39 form a continuous rounding of the corner. The external limiting surfaces of the closure plates are arranged in such a way that they are coplanar with the adjacent surfaces of the juxtaposed board shaped component parts. Further plates may be arranged within the middle part, these being in the form of intermediate walls corresponding to the previously described closure plates. Of course the closure plates may also be formed in such a way that the middle part has a rectangular cross section.

I claim:

1. A corner connector for board shaped component parts comprising: a hinge member of a continuous sheet of plastic material having a first half and a second half formed and connected to pivot about a hinge line, each of said first and second halves having a flat outer surface, a flat inner surface parallel with said flat outer surface, a first edge surface defining part of said hinge line, and a second edge surface spaced from said first edge surface a distance equal to the width of said flat outer and inner surfaces, a first side wall extending transversely to said flat inner surface of said first half at said second edge surface, said first side wall being formed integrally with said second edge surface of said first half, a second side wall extending transversely to said flat inner surface of said second half at said second edge surface, said second side wall being formed integrally with said second edge surface of said second half, said first and second side walls both extending parallel to each other and a similar distance from their respective edge surfaces, a plurality of means for engaging the board shaped component parts extending outwardly from each of said first and second side walls in a direction perpendicular to said second edge surfaces and away from said hinge line formed by said first edge surfaces of said first and second halves, first means extending perpendicularly from said flat inner surfaces of said first half away from said flat outer surface for interengaging with similar means on said flat inner surface of said second half, and second means extending perpendicularly from said flat inner surface of said second half away from said flat outer surface similar to said means on said flat inner surface of said first half for interengaging therewith, whereby when said first and second halves are pivoted about said hinge line said means for interengaging on said flat inner surfaces of said first and second halves are locked together to thereby form the corner connector.

2. The corner connector according to claim 1 wherein each of said first and second halves has a top end surface and a bottom end surface defined between said first and second edge surfaces, said top end surface of each of said first and second halves having a closure plate extending upwardly and transversely therefrom, said closure plates on the top end surfaces of said first and second halves having first means formed therein for interlocking said closure plates on the top end surfaces, said bottom end surface of each of said first and second halves also having a closure plate extending downwardly and transversely therefrom, said closure plates on said bottom end surfaces of said first and second halves having second means formed therein for interlocking said closure plates on said bottom end surfaces.

3. The corner connector according to claim 2, wherein each of said first and second means formed on said closure plates extending from said top and bottom end surfaces of said first half comprises a barbed tongue member extending upwardly from its respective closure plate, and each of said first and second means formed on said closure plates extending from said top and bottom end surfaces of said second half comprises a grooved member with a barb accepting recess formed therein for receiving one barbed tongue member.

4. The corner connector according to claim 1, wherein said first means for interengaging on said flat inner surface on said first half comprises at least one cylindrical member extending outwardly and away from said flat inner surface of said first half, said at least one cylindrical member having a slot formed along the length thereof with an enlargement at the top portion thereof; and said second means for interengaging on said flat inner surface of said second half comprising at least one cylindrical pin extending outwardly and away from said flat inner surface of said second half, said at least one cylindrical pin being positioned on said flat inner surface of said second half in an area corresponding to the position of said at least one cylindrical member on said flat inner surface of said first half so that when said first and second halves are pivoted toward each other for locking engagement said at least one cylindrical pin engages in the slot of said at least one cylindrical member for locking together said first and second halves.

5. The corner connector according to claim 1 further comprising a barbed arm extending perpendicularly from said first side wall of said first half toward said hinge line, and a flange member extending perpendicularly from said second side wall of said second half toward said barbed arm having a slot formed therein for the reception of said barbed arm when said first and second halves are pivoted toward each other about said hinge line for locking engagement.

6. The corner connector according to claim 1, further comprising at least one intermediate wall extending from said first side wall and said flat inner surface of said first half, and at least one intermediate wall extending from said second side wall and said flat inner surface of said second half corresponding in position to said at least one intermediate wall on said first half, so that when said first and second halves are pivoted toward each other about said hinge line said intermediate walls meet, each intermediate wall having an edge surface closest to said hinge line which is mitered.

7. The corner connector according to claim 1, wherein said hinge member, when said first and second halves are pivoted toward each other about said hinge line into the locked position, forms a post with a cross-section of a quadrantal sector.

8. The corner connector according to claim 7 wherein each of said first and second halves has a top end surface and a bottom end surface defined between said first and second end surfaces, each of said top end surfaces of said first and second halves having a closure plate extending upwardly and transversely therefrom, each closure plate on the top end surfaces of said first and second halves having a curved outer edge surface which together form said quadrantal cross-section of said post, and a mitred side edge surface closest to said hinge line, so that when said first and second halves are pivoted toward each other about said hinge line said mitred edge surfaces abut.

9. The corner connector according to claim 8 wherein portions of said outer edge surfaces of said closure plates on said first and second halves meet at said hinge line.

* * * * *